US006126067A

United States Patent [19]

Grigsby, Jr. et al.

[11] Patent Number: 6,126,067

[45] Date of Patent: Oct. 3, 2000

[54] AIR BREATHABLE BULK MATERIALS CONTAINER

[75] Inventors: John M. Grigsby, Jr., Woodstock; Jeffrey C. Banks, Austell, both of Ga.

[73] Assignee: North American Container Corporation, Smyrna, Ga.

[21] Appl. No.: 09/120,085

[22] Filed: Jul. 21, 1998

[51] Int. Cl.[7] ..... B65D 85/50

[52] U.S. Cl. ..... 229/120; 47/84; 220/676; 220/913; 229/122.32; 229/199.1

[58] Field of Search ..... 229/120, 122.34, 229/122.32, 122.33, 199.1; 220/676, 913; 47/84; 206/423; 426/124, 411, 419

[56] References Cited

U.S. PATENT DOCUMENTS

| | | | |
|---|---|---|---|
| 1,407,688 | 2/1922 | Banton | 229/120 |
| 2,533,773 | 12/1950 | De La Foret | 229/120 |
| 2,841,319 | 7/1958 | White et al. | 229/120 |
| 3,071,045 | 1/1963 | Budd | 229/120 |
| 3,486,680 | 12/1969 | Negus, Jr. | 229/120 |
| 4,515,266 | 5/1985 | Myers | 229/120 |
| 4,586,627 | 5/1986 | Grigsby . | |
| 4,635,815 | 1/1987 | Grigsby . | |
| 4,941,572 | 7/1990 | Harris | 229/120 |
| 5,575,418 | 11/1996 | Wu et al. | 229/120 |

FOREIGN PATENT DOCUMENTS

| | | | |
|---|---|---|---|
| 187837 | 8/1991 | Japan | 229/120 |

OTHER PUBLICATIONS

Wood–Cleated Corrugated, North American Container Corp, brochure (undated).

*Primary Examiner*—Gary E. Elkins
*Attorney, Agent, or Firm*—Kennedy, Davis & Hodge, LLP

[57] ABSTRACT

A container for leaf product and other bulk pack materials wherein a first blank of paperboard is bonded to a second blank of paperboard. A field of bores are defined in at least one side wall of the container by a high-speed non-fluted drill for communication of moisture from the container to the atmosphere for drying and long term storage of the leaf products.

17 Claims, 4 Drawing Sheets

AIR BREATHABLE BULK MATERIALS CONTAINER

TECHNICAL FIELD

The present invention relates to containers for holding and storing bulk materials. More particularly, the present invention relates to air-breathable containers that facilitate communication from the container of moisture emitted from bulk materials such as leaf products held in the container for drying and long-term storage.

BACKGROUND OF THE INVENTION

Bulk materials, such as powders, leaf and root crop products, metal castings, plastic resins, and many other materials are typically placed in large-volume containers for handling and storage of the bulk materials. Generally, the containers provide sturdy walls and closeable openings for protecting the bulk materials while allowing the containers to be handled by equipment such as fork lift trucks and platen trucks.

Some containers also facilitate the drying and curing of the bulk materials. For example, some leaf products are held in containers made with wood-slats that are secured together with enwrapping metal bands. There are gaps between adjacent edges of the wood slats in the wall of the container. As the leaf products emit moisture and dry, the moisture is communicated from the container through the gaps to the atmosphere. The escape of the moisture prevents mold from attacking the leaf products. These containers also allow for long-term storage of the leaf products. This enables the products to cure to useful raw material. The containers have sturdy walls which enable the containers to be stacked for storage in warehouses.

Since the total weight of a single loaded container may run as high as fifteen hundred (1500) pounds, the packing and shipping of bulk materials presents several unique problems. One problem is that such bulk materials are typically poured or thrown into the container and shipped loose so that the packed materials "flow" about the interior of the container. Materials of lesser densities may be pressed or compacted during filling of the container. After filling, the memory of the packed material exerts an outward force on the side walls of the pack. The side walls of the container must be sufficiently rigid in the horizontal plane to withstand internal movement or expansion of the materials and thereby must resist against bulging as a result of internal material flow. Another problem is that the side walls of the container must also be sufficiently rigid to permit stacking of one container on top of another. The side walls must provide sufficient compression strength to prevent any deformation or collapse of the container when others are stacked upon it.

U.S. Pat. No. 4,635,815 discloses a corrugated paperboard container having an exterior tubular corrugated paperboard body laminated to an interior tubular corrugated paperboard body, and includes a plurality of support members fixedly secured between the exterior and interior bodies so as to reinforce the container. While this container has been successful in long-term storage of bulk materials, it has not been gainfully used with fresh leaf products. The corrugated paperboard would prevent escape of moisture from the container. The leaf products would become damaged by mold and decay which leads to lost value. The leaf products must first dry by removal of the moisture held in the leaf products before long term storage can be made successfully with paperboard-type containers. However, transfer of such leaf products from the wood slat containers to the corrugated paperboard container after drying is not efficient. The wood slat containers have drawbacks to their continued use for leaf products. These problems include the costs and availability of such containers.

Accordingly, there is a need in the art for an improved air-breathable container that facilitates communication from the container of moisture emitted from the leaf products held in the container for drying and long-term storage. It is to such that the present invention is directed.

BRIEF SUMMARY OF THE INVENTION

The present invention solves the above-described problems in the prior art by providing a container that facilitates communication of moisture from the container for drying and long-term storage of leaf products. More particularly, the present invention provides a container for drying and long-term storage of leaf products. The container comprises a blank of a sheet material scored to define two opposing end panels and two opposing side panels. The blank is foldable on the scores and a pair of opposing distal ends are adhered together to define a tubular body openable from a first position which is substantially flat to a second position squared-open for receiving a plurality of leaf products within a cavity defined by the opposing end and side panels. At least one of the panels defines a field of spaced-apart bores for communicating moisture through the panel. A bottom closes a first open end of the tubular body and a top cap closes a second open end of the tubular body. The leaf products, being held within the tubular body, emit moisture which communicates through the field of bores in the panel to atmosphere for drying and long-term storage of the leaf products.

A second preferred embodiment of the present invention includes an outer wall-forming blank of paperboard scored to provide a series of wall panels foldably joined together and a second wall-forming blank of paperboard also scored to provide a series of wall panels foldably joined together. The second wall-forming blank is formed for bonding to the inside surface of the first wall-forming blank. A plurality of support members are fixedly retained between the first wall-forming blank and the second wall-forming blank, with at least one support member being provided on each wall of the container. Further, a plurality of sheet-like members are secured between both the first wall forming blank. Each sheet-like member preferably comprises a blank of corrugated paperboard. At least one of the walls defined by the blanks defines a field of spaced-apart bores for communicating moisture through the wall. The unitary container accordingly facilitates communication of moisture from leaf products to atmosphere while reinforced side walls provide compression strength and prevent against any bulging.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
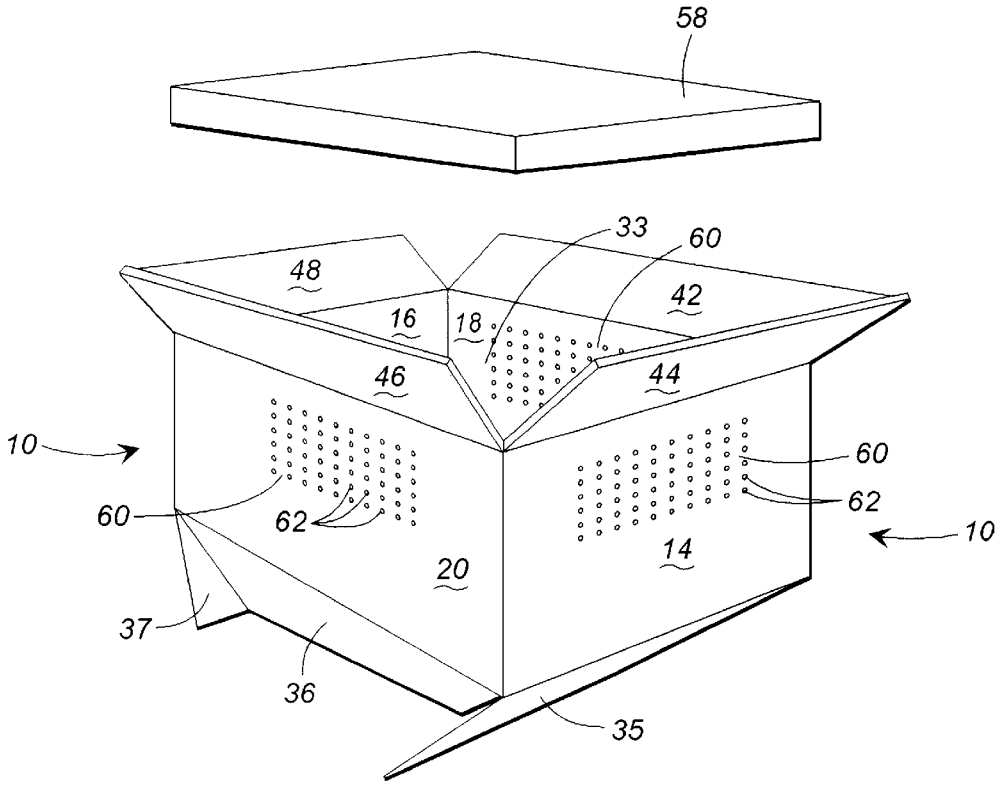
FIG. 1 is a pictorial view of an embodiment of a bulk material container according to the present invention.
Figure 2:
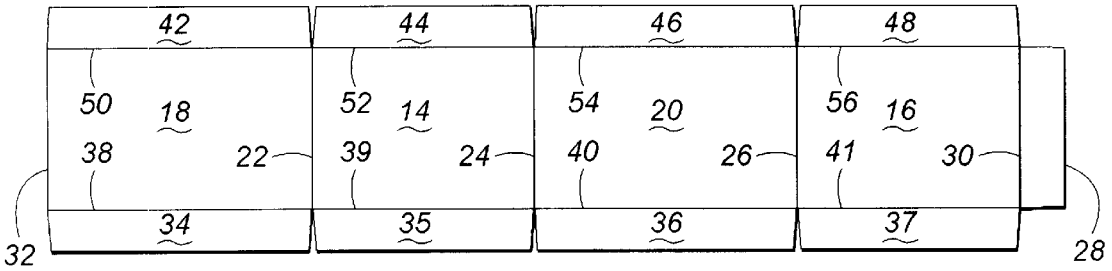
FIG. 2 is a plan view of a paperboard blank for forming the bulk material container illustrated in FIG. 1.

Referring now in more detail to the drawings, in which like numerals indicate like parts throughout the several views, FIG. 1 illustrates a container 10 of the present invention for holding bulk materials for drying and long-term storage. The container 10 is formed from a blank of sheet material 12 illustrated in FIG. 2. The sheet material 12 is preferably corrugated paperboard. The sheet material 12 includes two opposing end panels 14, 16 and two opposing side panels 18, 20 foldably connected along scores 22, 24, and 26. The end panels 14, 16 and the side panels 18, 20 define the sides of the container 10 shown in FIG. 1. A manufacturer's joint flap 28 foldably connects on a score 30 to the end panel 16. The manufacturer's joint flap 28 attaches with adhesive to a side portion 32 of the side panel 18 to form a tubular body for the container 10. The scores 22, 24, 26, and 30 permit the container 10 to substantially flatten to a knock-down position for shipping from a container manufacturer to a company using the container. For use, the container 10 is squared-open as in FIG. 1 to define a cavity 33 for holding bulk materials.

FIG. 1 further shows a series of four bottom flaps 34, 35, 36, and 37 foldably attached to the end and side panels 14, 16, 18, and 20, respectively, along scores 38, 39, 40, and 41. Similarly, a series of four top flaps 42, 44, 46, and 48 foldably attach on an opposing side of the end and side panels 14, 16, 18, and 20, respectively, along scores 50, 52, 54, and 56.

FIG. 1 further shows a cap member 58 positioned immediately above the container 10. The cap member 58 may be formed of any suitable material, such as corrugated paperboard, and is provided for closing off the top of the container 10. Thus, the cap member 58 is dimensioned so as to fit snugly over the top of the container 10. The details of the cap member 12 are outside the scope of the present invention and thus, it is not disclosed further herein.

Those skilled in the art will recognize that FIG. 1 shows no bottom support member such as a pallet or a slip sheet under the bottom of the container 10. Of course, various bottom support members could be provided including, but not limited to, pallets, slip sheets and bottom caps. Such bottom support members are well known in the art, and hence, need not be disclosed further herein. Thus, it is to be understood that the present invention has applications exclusive of conventional corrugated paperboard containers. For example, the present invention may take the form of a tube-like container consisting of only side walls with no top or bottom flaps, but having top and bottom caps similar to the top cap 58.

The container 10 of the present invention is breathable for communication of air and moisture from the cavity 33 to the atmosphere. At least one of the panels defining the walls of the container 10 is provided with a field 60 of bores 62. In the illustrated embodiment, each of the opposing end and side panels 14, 16, 18, and 20 are provided with the fields 60 of bores 62. The fields 60 each preferably define a square 30-by-30 grid of bores 62, although other field patterns and numbers of bores can be used. The bores permit moisture to pass from the cavity 33 to atmosphere, but restrict passage of contaminants into the cavity. The diameter of the bores 62 ranges from between 0.037 inch to 0.065 inch. The diameter of the bores 62 are preferably about 0.051 inch. The bores are preferably on one-inch centers. These bores are large enough to allow sufficient air flow and release of moisture from the container, yet small enough to prevent dust and other particles from existing the container while keeping insect and debris from entering. Excess paper fibers on the inside container may contaminate the product inside the container. Excess paper fibers on the outside of the container may be forced back into the hole or otherwise cover over a portion of the opening which reduces the breatheability of the container. Such closing of the hole may be caused by handling the container with platen-type container handling equipment, or even when the containers are knocked-down and stacked for transport from the container manufacturer to the end user customer.

Figure 3:
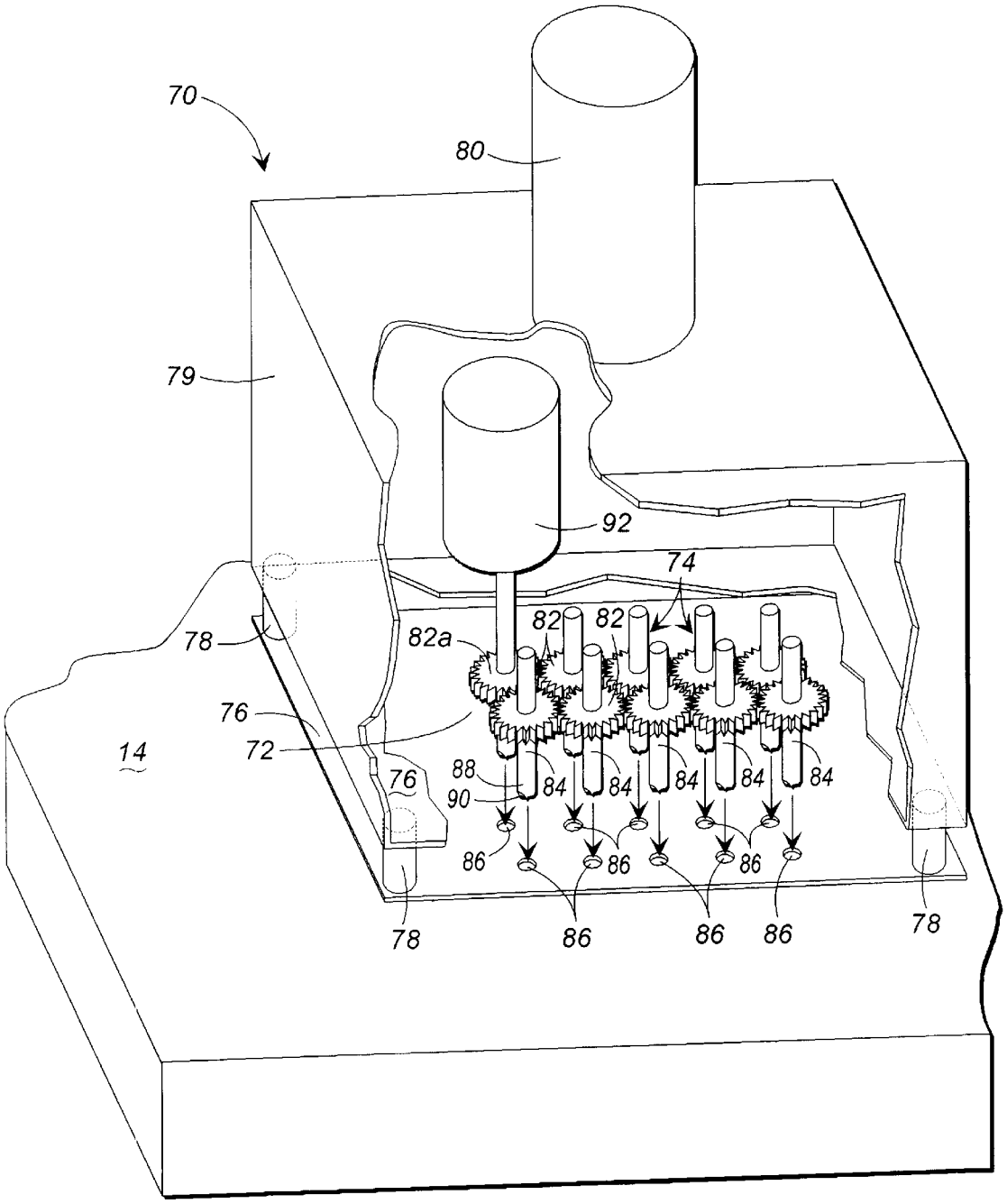
FIG. 3 is a pictorial view of a module having an array of interlinked drills for forming a field of bores in the panels of the bulk container illustrated in FIG. 1, for communicating moisture emitted from the materials in the container to atmosphere.

FIG. 3 is a pictorial view of a module 70 having an array 72 of interlinked drills 74 for forming a portion of the fields 60 of bores 62 in the panels of the container 10. The module 70 has a pair of parallel plates 76 which are secured in spaced-apart relation by posts 78. A frame 79 attaches to the plates 76 and connects to a moveable arm 80 for moving the module 70 between a first position and a second position for drilling the bores 62 in the panel, for example the panel 14 as illustrated. A plurality of gears 82 are disposed in an array between the plates 76. Each gear 82 includes a shank 84 which extends through a respective opening 86 in the plates. A distal end 88 of the shank 84 terminates in a cutting face 90. The drills 74 are preferably non-fluted drills having tips which define a cone-shape in cross-sectional view. One of the gears 82*a* connects to a direct current motor 92. The motor 92 turns the gears at speeds of between about 3,500 revolutions per minute to about 5,000 revolutions per minute. A stepping motor is particularly useful for slowly increasing the speeds of the drills at reasonable increments.

The module 70 operates to form a portion of the bores 62 in the panels 14, 16, 18, and 20. The motor 92 operates and causes the shank 84 of the gear 82*a* to rotate in a first direction. The gears 82*b* and 82*c* rotate in a second opposite direction. The remaining gears 82 rotate in directions opposite that of the adjacent gears. The arm 80 moves the module 70 from the first position with the distal ends 88 of the shanks 84 spaced apart from the panel 14 towards the panel to bring the cutting face 90 into contact with the panel. The arm 80 continues to move causing the cutting faces 90 to cut into and through the material of the panel to a second position with the end portions of the shanks 84 extending outwardly of the panel. The preferred non-fluted drills produce neat entrance and exit openings in the walls. The high speed drills tend to push the paper fibers aside as the hole is formed rather than driving the fibers outwardly. The drills spread the fibers apart and crush the fibers around the perimeter of opening being formed. With the motor continuing to operate, the arm 80 is retracted to extract the shanks 84 from the panel. The module 70 is then repositioned relative to the panel 14, and additional bores 62 are formed, until the sufficient number of bores are formed. As may be appreciated, other modules may be ganged together with the module 70 for drilling an increased number of the bores 62 simultaneously, or the number of drills per module increased. In an alternate embodiment the fields 60 of bores 62 are formed by an array of water jets. Yet another embodiment uses lasers for forming the bores 62.

Figure 4:
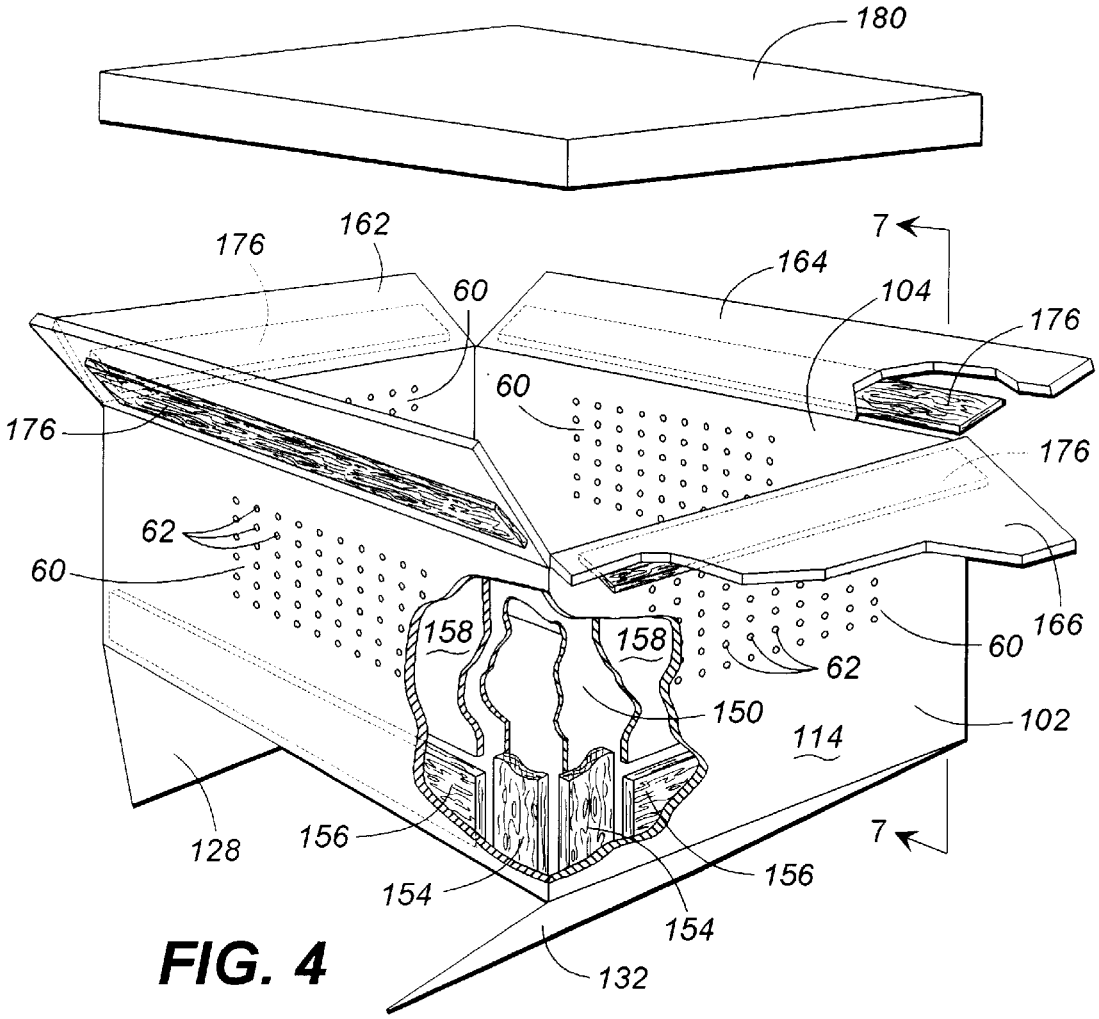
FIG. 4 is a pictorial view of an alternate embodiment of a bulk material container according to the present invention, with a portion of the container cut away to show the support members.
Figure 5:
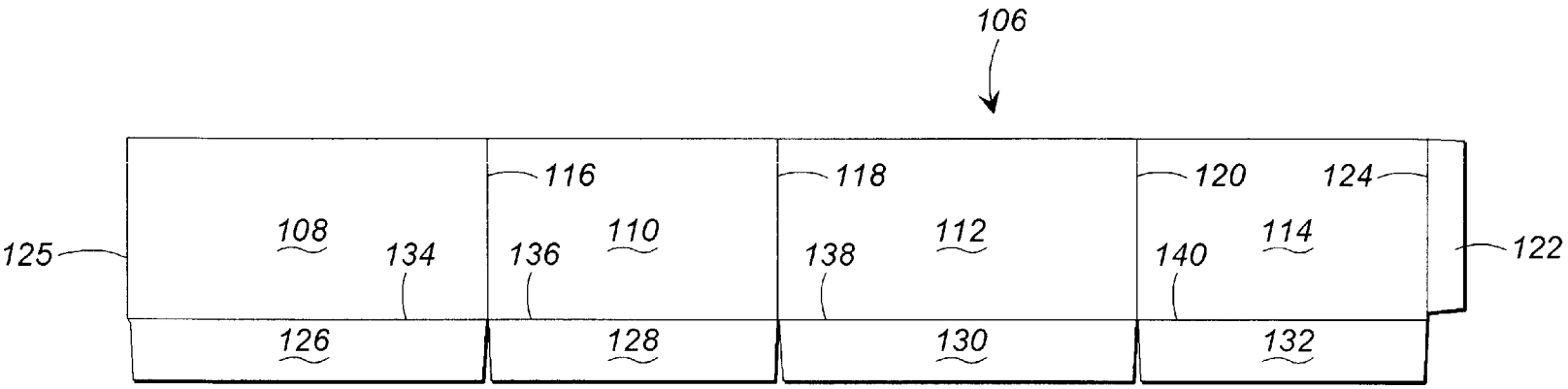
FIG. 5 is a plan view of a paperboard blank for forming an outer shell of the container shown in FIG. 1.

FIG. 4 illustrates an alternate embodiment of the container according to the present invention, which container 100 is formed with an outer shell 102 and an inner liner 104 and includes support members as discussed below. FIG. 5 illustrates a plan view of a blank 106 of a sheet material suitable for forming the outer shell 102. The preferred sheet material is corrugated paperboard. The outer shell blank 106 includes four main panels 108, 110, 112, 114 foldably connected along three score lines 116, 118, and 120. The four main panels 108, 110, 112, 114 form the four outer side walls of the container 100 as shown in FIG. 4. A manufacturer's joint flap 122 is foldably connected to the main panel 114 along a score line 124. The outer shell joint flap 122 attaches to a side portion 125 of the panel 108 to form a collapsible tubular body for the container 100, as described below. Those skilled in the art will appreciate that the outer shell 102 may be modified so that manufacturer's joint flap 122 is positioned within the container 100 instead of lapped over the outside. Such an arrangement is also well-known in the art. A series of four bottom flaps 126, 128, 130 and 132 are foldably connected to the main panels 108, 110, 112, and 114, respectively, along respective score lines 134, 136, 138, and 140.

Figure 6:
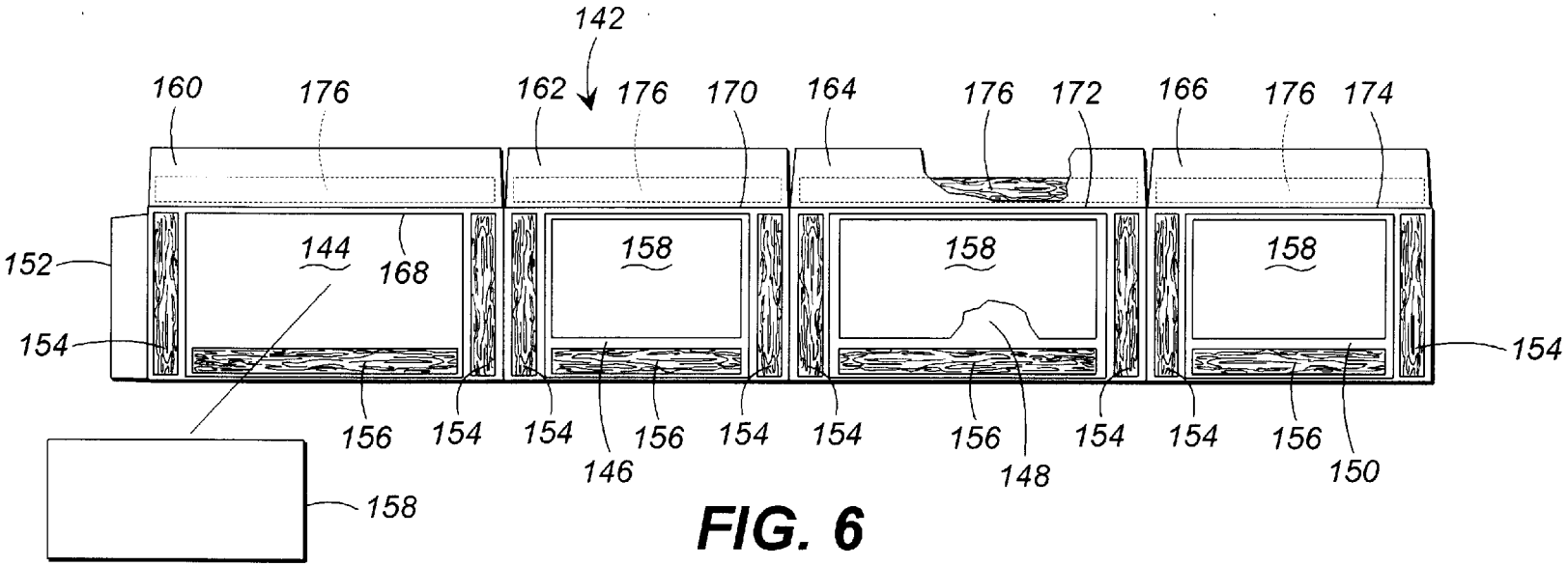
FIG. 6 is a plan view of a paperboard blank for forming the depth liner or inner wall portion of the container shown in FIG. 1, showing the reinforcing members and spacer pads bonded to the depth liner.

FIG. 6 shows a blank 142 of sheet-like material suitable for forming the inner liner 104. While other materials may be used, the preferred material is corrugated paperboard. The inner liner blank 142 includes four main panels 144, 146, 148, and 150, defined by scores in the blank. The main panels 144, 146, 148, and 150 form the four innermost side walls of the container 100 when the inner liner 104 is bonded to the outer shell 102 as described below. The inner liner blank 142 provides a joint flap 152 foldably connected to the main panel 144 along a score line 154. The joint flap 152 attaches with adhesive to side portion of the panel 150.

A plurality of reinforcing or support members 154 are bonded to a first side surface of the inner liner 104. The first side surface of the inner liner 104 (shown in FIG. 6) is that side of the inner liner that is to be engaged to the outer shell 102. The support members 154 may be formed of any suitably rigid material. A particularly preferred material is a wood veneer, typically ranging in thickness from ⅛ inch to ½ inch and in width from 2 and ¾ inches to 3 and ¾ inches. The length of the support members 154 depends upon the height of the container 100. Preferably, the length of the support members 154 is substantially equal to the height of the depth liner 104, which is, in turn, substantially equal to the interior or inside height of the container 100.

One support member 154 is preferably secured to the left and right end portion of each main panel 144, 146, 148, and 150 of the inner blank 142. This bonding may be done using any suitable adhesive. The support members 154 are aligned and secured vertically so to provide the maximum supporting effect when the container 100 is squared-open and erected for use. This positioning results in the support members 154 being located near the corners of the container 100 upon erection of the container. The support members 154 are preferably bonded as close to the corners as possible, but not so close as to prevent the container from being folded down into a substantially flat position. Additionally, in order to further increase container rigidity and compression strength, a support member 154 may be bonded near the center or otherwise intermediate of the outer ends of the main panels 144, 146, 148, and 150 (not illustrated).

As illustrated in FIG. 6, the blank 142 further includes four elongate members 156 with one of such members attached to respective side portions of the main panels 144, 146, 148, and 150. The members 156 are disposed in coaxial alignment and parallel to a longitudinal axis of the blank 142. The members 156 may be formed of any suitably rigid material. A particularly preferred material is wood. The thickness is preferably equal to that of the support members 154, typically ranging in thickness from ⅛ inch to ½ inch and in width from 2 and ¾ inches to 3 and ¾ inches. The members 156 attach to the blank 142 with adhesive or other suitable bonding material.

The inner liner 104 further includes four filler pads 158 with one attached to each of the main panels 144, 146, 148, and 150. The filler pads 158 are formed of any suitably rigid sheet material. A particularly preferred material is corrugated paperboard. The thickness is preferably equal to that of the members 154 and 158. For example, the filler pads 158 are preferably doublewall corrugated paperboard. The filler pads 158 attach to the blank 142 with adhesive or other suitable bonding material. The filler pads 158 fill the volume between the support members 156 and 158, to provide a substantially level face for the inner liner 104 which adheres to the outer shell 102, as discussed below.

An alternate embodiment (not illustrated) does not use the supports 158. The filler pads 158 in this embodiment extend the full height of the inner liner 104. Furthermore, the blanks 106 and 142 may be conventionally formed of paperboard having substantially vertical corrugations. However, the filler pads 158 are preferably made of paperboard having substantially horizontal corrugations. Of course, the blanks 106 and 142 may be formed of paperboard with horizontal corrugations and the filler pads 158 formed of paperboard with vertical corrugations.

The blank 142 further includes a series of four top flaps 160, 162, 164, and 166 foldably joined to the main panels 144, 146, 148, and 150, respectively, along respective score lines 168, 170, 172, and 174. An elongate member 176 attaches to each of the top flaps 160, 162, 164, and 166 on the opposing second side of the blank 142, as shown in partial cut-away view in FIG. 6. Similar to the members 156, the members 176 are disposed in coaxial alignment and parallel to the longitudinal axis of the blank 142. The members 176 may be formed of any suitably rigid material. A particularly preferred material is wood. The thickness is preferably equal to that of the support members 154, typically ranging in thickness from ⅛ inch to ½ inch and in width from 2 and ¾ inches to 3 and ¾ inches. The members 176 attach to the blank 142 with adhesive or other suitable bonding material.

Figure 7:
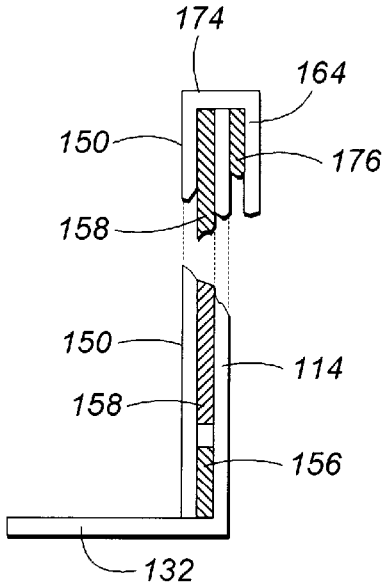
FIG. 7 is a side view illustrating the structure of the container illustrated in FIG. 4.

FIG. 7 shows the corner of the container 100 taken along the lines 7—7 of FIG. 4, and, thereby, shows construction of the same. As discussed below, the inner liner 104 made with the blank 142 shown in FIG. 6 is laminated to the outer shell 102. The side walls of the container 100 accordingly comprise a multiple layer laminate. In particular, the panel 114 of the outer shell 102 and the panel 150 of the inner liner 104 sandwich the support member 154, the member 156, and the filler pad 158. The top flap 166 folds on the score 174 to overlap the upper edge of the panel 114 and thereby dispose the member 176 against the outside surface of the panel 114. The bores 62 in the field 60 in the side wall are not illustrated in FIG. 7.

The container 100 is manufactured in accordance with the following method. The outer shell blank 102 and the inner liner blank 142 are manufactured as discussed above with respect to FIGS. 5 and 6. The outer shell blank 102, the inner liner blank 142, and the filler pads 158 are preferably formed of double wall corrugated paperboard. As shown in the drawings, the double wall paperboard is particularly well suited for practice of the present invention. The support members 154 are then bonded to the depth liner of the paperboard blank 142. More particularly, the first side (or inside) of each main panel 144, 146, 148, and 150 of the depth liner blank 142 is provided with a wood support member 154 at its respective left and right edge portion. As described above, the support members 154 are preferably maintained a distance away from a corner portion of the container so as to provide for the containers being knocked down prior to shipment. The members 156 are attached to side portion with adhesive or bonding material. Further, the filler pads 158 are attached to the first side of the blank 142. The members 176 are then attached to the second side of the blank 142 to the opposing face of the top flaps 160, 162, 164, and 166.

Those skilled in the art will appreciate that the dimensions of the support members 154 (as well as the density of the paperboard) may be varied to provide a desired container strength. Those skilled in the art will further appreciate that additional support members 154 may be added intermediate those shown at the left and right edge portions of the main panels 144, 146, 148, and 150 if the particular application of the present invention requires such.

Once the support members 154 are glued or otherwise bonded to the inner liner 104, the blank 142 may be bonded to the outer shell 102 in the conventional manner. A preferred method is to extrude or roll an adhesive material either onto the outer shell 102 or the inner liner 104. The blanks 106 and 142 are then aligned together and passed through a compression device, thereby bonding same.

In accordance with the present invention, the fields 60 of bores 62 are then formed in the panels defining the side walls of the container 100. The fields 60 are formed with the drill module 70, as discussed above with respect to FIG. 3. The motor 92 operates to cause the array of drills to rotate. The arm 80 moves the module 70 from the first position with the cutting faces of the drills 74 spaced apart from the panel towards the panel to bring the cutting face 90 into contact with the panel. The arm 80 continues to move, causing the cutting faces 90 to separate paper fibers as the bores 62 are formed as the drill cuts into and through the paper fiber material of the panel. The arm 80 moves to the second position with the end portions of the shanks 84 extending outwardly of the panel. With the motor continuing to operate, the arm 80 is retracted to extract the drills 74 from the panel. The module 70 is then repositioned relative to the panel 14, and additional bores 62 are formed, until the sufficient number of bores are formed. Each drill 74, having only a cutting face 90 and no flutes, tends to push the paper fibers in the paperboard aside, while cutting a neat hole in the corrugated paperboard blanks 106 and 142. These drills generally do not pull the cut material out the bore 62 formed by the drill. The drills are relatively easily inserted and retracted from the blanks.

After the fields 60 are formed, the joint tabs 152 and 122 are then adhered to respective surfaces of the panel 158 and 108, to form a tubular, collapsible container 100 illustrated in FIG. 4.

Prior to use, the knocked-down container 100 is squared-open to define the cavity for receiving bulk materials. The bottom flaps 126, 128, 130, and 132 are folded towards the respective opposing flap on the respective scores 134, 136, 138, and 140 to close the open lower end of the container 100. The top flaps 160, 162, 164, and 166 are folded outwardly to bring the respective member 176 into contact with the respective outside surfaces of the panels 108, 110, 112, and 114 of the outer shell 102. As illustrated in FIG. 4, a band 180 wraps around the container 100 on the folded-over top flaps 160, 162, 164, and 166 to secure the top flaps in position.

An alternate embodiment (not illustrated) does not provide the top flaps 160, 162, 164, and 166 in the blank 142 shown in FIG. 6. Rather, the members 176 attach in coaxial alignment to the panels 144, 146, 148, and 150, on a side opposing the members 156. The filler panels 158 are necessarily reduced in size to fit between the members 156 and 176 and the support members 154 on the respective sides of the panels 144, 146, 148, and 150.

FIG. 4 further shows a cap member 180 positioned immediately above the container 100. The cap member 180 may be formed of any suitable material, such as corrugated paperboard, and is provided for closing off the top of the container 100. Thus, the cap member 180 is dimensioned so as to fit snugly over the top of the container 100. The details of the cap member 180 are outside the scope of the present invention and thus, it is not disclosed further herein. Yet another embodiment (not illustrated) likewise attaches the member 176 to the panels 144, 146, 148, and 150, as discussed above. However, this embodiment includes top flaps on the blank 106 defining the outer shell 102. These top flaps fold on scores towards a respective opposing top flap to close the open top of the container.

Thus, the present invention provides an improved breathable bulk material container particularly suited for holding leaf products for drying and long-term storage. Moisture from the drying leaf products communicates through the bores 62 in the fields 60 of the side walls of the container 100. The support members 154 provide the container with an increased side wall rigidity for both stacking strength and bulge resistance. The members 156 and 176 provide additional side wall strength for handling of the container 100. The placement of the support members 154 between the outer shell 102 and the inner liner 104 insures that the bulk materials stored within the container 100 is not disturbed or damaged by such support member during filling, handling and storage of the containers. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A container for drying and long-term storage of leaf products, comprising:

a body defined by folding a blank of a fibrous sheet material scored to define two opposing end panels and two opposing side panels and adhering together opposing distal ends thereof, said body openable from a first position which is substantially flat to a second position squared-open for receiving a plurality of leaf products therein;

at least one of the panels defining a field of spaced apart bores for communicating moisture through the panel, said bores defined by operation of a high-speed, non-fluted drill pushing through the panel;

a bottom that closes a first open end of the tubular body; and a top cap that closes a second open end of the tubular body, whereby the leaf products, being held within the tubular body, emit moisture which communicates through the field of bores in the panel to atmosphere for drying and long-term storage of the leaf products.

2. The container as recited in claim 1, wherein the sheet material comprises corrugated paperboard.

3. The container as recited in claim 1, wherein the bottom comprises a plurality of bottom flaps, each foldably attached on a score to a respective one of the opposing end and side panels on a first edge of the blank.

4. The container as recited in claim 1, wherein the top cap comprises a plurality of top flaps, each foldably attached on a score to a respective one of the opposing end and side panels on a second edge of the blank.

5. The container as recited in claim 1, wherein the diameter of each said bore is in a range of between 0.037 inch and 0.065 inch.

6. A container for drying and long-term storage of leaf products made by the process comprising the steps of:

(a) providing a blank of a fibrous sheet material scored to define two opposing end panels and two opposing side panels;

(b) drilling with a non-fluted drill having a cutting tip a field of spaced-apart bores in a portion of at least one of the opposing panels for communicating moisture through the panel;

(c) folding the blank on the scores;

(d) adhering a pair of opposing distal ends of the blank adhered together to define a tubular body openable from a first position which is substantially flat to a second position squared-open for receiving a plurality of leaf products within a cavity defined by the opposing end and side panels;

(e) providing a bottom and a top cap that close opposing open ends of the tubular body, whereby leaf products, being held within the tubular body, emit moisture which communicates through the field of bores in the panel to atmosphere for drying and long-term storage of the leaf products.

7. The container made by the process recited in claim 6, wherein the sheet material provided in step (a) comprises corrugated paperboard.

8. The container made by the process recited in claim 6, wherein the bottom provided in step (e) comprises a plurality of bottom flaps, each foldably attached on a score to a respective one of the opposing end and side panels on a first edge of the blank.

9. The container made by the process recited in claim 6, wherein the top provided in step (e) comprises a plurality of top flaps, each foldably attached on a score to a respective one of the opposing end and side panels on a second edge of the blank.

10. The container made by the process recited in claim 6, wherein the drilling defines bores having diameters of between about 0.037 inch and 0.065 inch.

11. A reinforced bulk material container, comprising:

a first body defined by a first wall-forming blank of paperboard scored to provide a series of main panels foldably joined together at a plurality of corners, said first wall-forming blank defining an inside surface and an outside surface;

a second body defined by a second wall-forming blank of paperboard scored to provide a series of main panels foldably joined together at a plurality of corners, said second wall-forming blank defining a front side surface and a back side surface and said second body received within said first body;

a pair of independent support members glued to the backside of said second wall-forming blank at the location of each said corner, said pair of support members each extending substantially the height of said second wall forming blank and arranged so as to straddle and be spaced apart from the score defining the respective one of the corners;

said backside surface of said second wall-forming blank being laminated to said inside surface of said first wall-forming blank so as to provide a unitary container having a series of reinforced side walls foldably joined together;

at least one of the side walls defining a field of spaced-apart bores for communicating moisture through the panel said bores defined by operation of a high-speed non-fluted drill pushing through the panel, whereby moisture from products placed in the interior of said container communicates through said bores.

12. The reinforced bulk material container as recited in claim 11, further comprising a filler pad bonded to each main panel of said second wall-forming blank, said filler being formed of corrugated paperboard and dimensioned so as to extend substantially the width of said main panel between said support members secured thereto and substantially the height of said second wall forming blank.

13. The reinforced bulk material container as recited in claim 11, wherein the diameter of each said bore is in a range of between 0.037 inch and 0.065 inch.

14. The reinforced bulk material container as recited in claim 11, further comprising at least two elongate members attached to the backsides of respective opposing main panels of the second wall-forming blank.

15. The reinforced bulk material container as recited in claim 11, further comprising a plurality of top flaps foldably joined to the upper edge portion of the wall panels of the second wall-forming blank for being foldably overlapped over a upper edge of the first wall-forming blank.

16. The reinforced bulk material container as recited in claim 15, further comprising a support member attached to a bottom surface of at least one of the top flaps.

17. The reinforced bulk material container as recited in claim 11, further comprising a bottom and a top that close opposing open ends of the container.

* * * * *